US008354603B2

(12) United States Patent
Dostal et al.

(10) Patent No.: US 8,354,603 B2
(45) Date of Patent: Jan. 15, 2013

(54) SWITCHING DEVICE

(75) Inventors: Ladislav Dostal, Zamberk (CZ); Lukas Jerabek, Zamberk (CZ); Libor Krivanek, Kunvald v Cechách (CZ); Christian Rohrwild, Lappersdorf (DE)

(73) Assignee: Siemens Aktiengesellschaft, Munich (DE)

( * ) Notice: Subject to any disclaimer, the term of this patent is extended or adjusted under 35 U.S.C. 154(b) by 275 days.

(21) Appl. No.: 12/898,039

(22) Filed: Oct. 5, 2010

(65) Prior Publication Data

US 2011/0083949 A1 Apr. 14, 2011

(30) Foreign Application Priority Data

Oct. 8, 2009 (DE) ..... 10 2009 048 707

(51) Int. Cl.
*H01H 9/00* (2006.01)
*H01H 33/00* (2006.01)

(52) U.S. Cl. ..... 200/50.01; 200/50.02; 200/293; 200/303; 200/308; 200/334; 335/172

(58) Field of Classification Search ..... 200/400, 200/401, 293, 294, 303, 307, 308, 334, 17, 200/18, 50.01, 50.02 R; 218/146, 155; 335/6, 335/8–10, 23–25, 35, 167–176, 132, 202; 361/652–656, 673, 809, 810, 825, 627, 628, 361/660

See application file for complete search history.

(56) References Cited

U.S. PATENT DOCUMENTS

| | | | | |
|---|---|---|---|---|
| 3,474,206 | A * | 10/1969 | Gryctko | 200/293 |
| 3,711,748 | A * | 1/1973 | Dietz | 361/673 |
| 4,156,121 | A * | 5/1979 | Klein et al. | 200/293 |
| 4,553,115 | A * | 11/1985 | Grunert et al. | 335/14 |
| 4,829,278 | A * | 5/1989 | Livesey et al. | 337/50 |
| 4,963,846 | A * | 10/1990 | Grunert et al. | 335/42 |
| 5,508,670 | A * | 4/1996 | Mantzouridis et al. | 335/172 |
| 5,719,363 | A * | 2/1998 | Handler | 200/50.02 |
| 6,229,692 | B1 * | 5/2001 | Stendardo et al. | 361/627 |
| 7,187,177 | B2 * | 3/2007 | Kelly et al. | 324/424 |
| 7,358,837 | B2 * | 4/2008 | Puskar et al. | 335/6 |

* cited by examiner

*Primary Examiner* — Michael Friedhofer
(74) *Attorney, Agent, or Firm* — Harness, Dickey & Pierce, P.L.C.

(57) ABSTRACT

A switching device includes a switching appliance, a cap, at least one connecting device for firm connection of the switching appliance to the cap, and a monitoring device. In at least one embodiment, the monitoring device includes a sensor and a tripping element, whose position is variable after connection and which, when the switching appliance is ready to operate, is located in a position in which the tripping element can be detected by the sensor, the monitoring device further including a signal unit which is connected to the sensor and is used to signal operational readiness once the sensor has detected this.

9 Claims, 1 Drawing Sheet

SWITCHING DEVICE

PRIORITY STATEMENT

The present application hereby claims priority under 35 U.S.C. §119 on German patent application number DE 10 2009 048 707.7 filed Oct. 8, 2009, the entire contents of which are hereby incorporated herein by reference.

FIELD

At least one embodiment of the invention generally relates to a switching device including a switching appliance, a cap, at least one connecting device for firm connection of the switching appliance to the cap, and including a monitoring device.

At least one embodiment of the invention also generally relates to a method for automatic detection and signaling of the operational readiness of a switching device which includes a switching appliance and a cap, onto which the switching appliance can be plugged, and includes at least one connecting device, by which the switching appliance is firmly connected to the cap.

BACKGROUND

Switching devices such as these are in practical use. For example, a microswitch is used here as a monitoring device, which detects only whether there is a circuit breaker in the cap. However, the switching appliance is ready to operate only when there is a firm connection to the cap.

SUMMARY

In at least one embodiment of the invention, a switching device is disclosed which allows reliable, automatic detection and signaling of the operational readiness of the switching appliance, in a simple manner.

In at least one embodiment of the invention, a method is disclosed, in which the operational readiness of the switching appliance is reliably monitored and signaled in a simple manner.

In this case, the monitoring device has a sensor and a tripping element, whose position is variable after firm connection and which, when the switching appliance is ready to operate, is located in a position in which the tripping element can be detected by the sensor, and has a signal unit which is connected to the sensor and is used to signal operational readiness once the sensor has detected this.

One development at least one embodiment of the invention, is for the tripping element to be engaged with a catch mechanism of the switching appliance only in the operational readiness state.

It is particularly advantageous if for the at least one connecting device to be in the form of screws.

A further advantageous embodiment is for the sensor to be electrically connected to the signal unit.

It is also particularly advantageous for the signal unit to be in the form of a communication device.

In at least one embodiment, the method includes:

a) The position of a tripping element is changed after the connection of the switching appliance to the cap,
b) A sensor detects the tripping element in its position in which the switching appliance is ready to operate,
c) In response to which the operational readiness is signaled.

BRIEF DESCRIPTION OF THE DRAWINGS

One example embodiment of the invention will be explained in more detail in the following text with reference to a drawing, in which.

DETAILED DESCRIPTION OF THE EXAMPLE EMBODIMENTS

Figure 1:
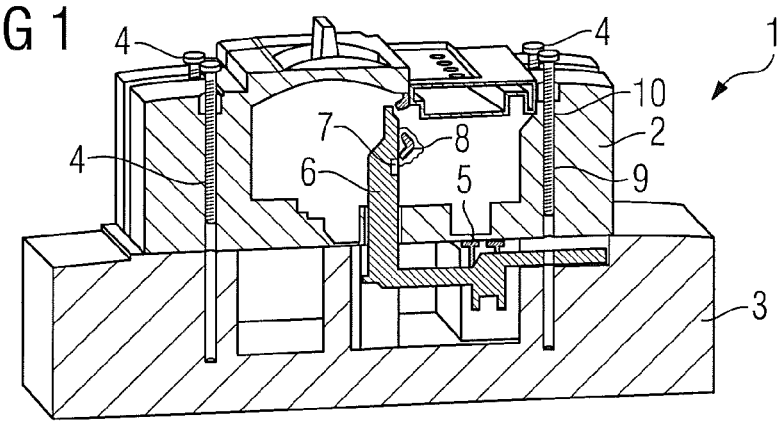
FIG. 1 shows a switching device according to an embodiment of the invention having a switching appliance which is not ready to operate.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

FIG. 1 shows a switching device 1 with a switching appliance 2 which is plugged onto a cap 3. Connecting devices 4, in this case screws, are used for firm connection of the switching appliance 2 to the cap 3. Until the screws have been screwed into the cap 3, there is no firm connection and, in this state, the switching appliance 2 is not ready to operate. This is because the current forces which occur in the event of a short circuit would result in considerable danger and damage if the switching appliance were in the unsecured state, without being held firmly.

In order to reliably detect and to signal the operational readiness of the switching appliance 2, the switching device 1 is provided with a monitoring device which comprises a sensor 5 and a tripping element 6 whose position can be changed by a further screw 10. This screw 10, which is connected to the monitoring device, is inserted into the elongated hole 9 in the switching appliance 2, after the switching appliance 2 has been firmly connected to the cap 3 by the other screws 4, until the thread on the screw 10 can be screwed into the internal thread in the tripping element 6, as can be seen by the indication in the section illustration shown in FIG. 3. Once the screw 10 has been screwed into the internal thread in the tripping element 6, it rests on a stop in the insertion opening for the screw 10 and now drives the tripping element 6 upward, when rotated further, toward the front face of the switching appliance 2, to the position shown in FIG. 2, in which the tripping element 6 rests on the stop, which is not illustrated here.

Figure 2:
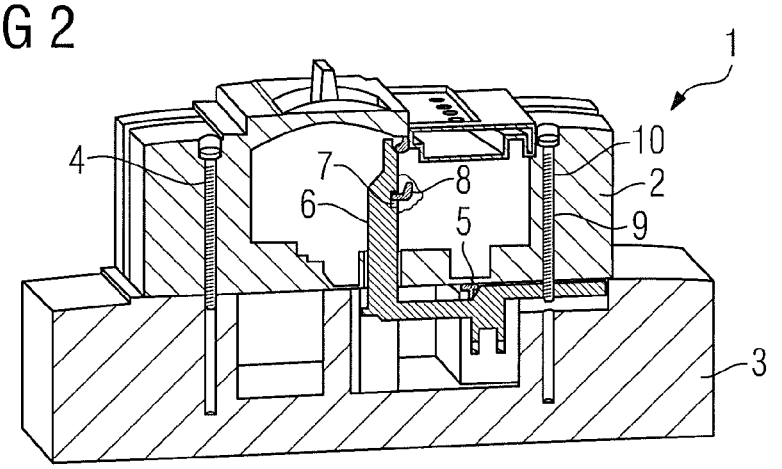
FIG. 2 shows a switching device according to an embodiment of the invention having a switching device which is ready to operate.
Figure 3:
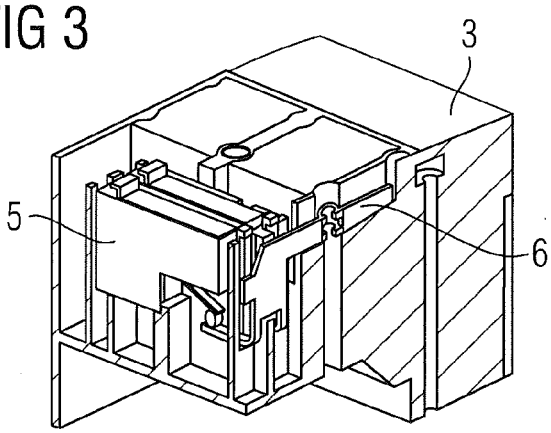
FIG. 3 shows a detail of a cap of the switching device according to an embodiment of the invention.

This position of the tripping element 6, which can be achieved only when the switching appliance 2 has previously been firmly connected to the cap 3 by the screws 4, is detected by a sensor 5 as shown in FIGS. 1, 2 and 3. As FIG. 3 shows, the sensor 5 is mounted in the cap 3.

A signal unit, which is connected to the sensor 5 but is not illustrated in the drawing, is triggered after detection by the sensor 5, and then signals the operational readiness of the switching appliance 2 locally or, for example, to a remote control room. In this case, the signal unit may be in the form of a communication device, although other signaling capabilities are likewise feasible, by radio, by optical or by acoustic signals.

The tripping element 6 is angled and is provided with a notch 7 in which a projection 8 on a catch mechanism of the switching appliance 2 engages when the operational readiness position is reached. This is the only way in which it is possible to switch on the switching appliance 2.

In the situation in which there is no firm connection between the switching appliance and the cap, when the switching appliance is switched on, the tripping element is pressed out of the switching appliance by a spring, and the sensor detects the state of non-operational readiness, which is signaled by the signal unit.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A switching device comprising:

a switching appliance;

a cap;

at least one connecting device to firmly connect the switching appliance to the cap; and a monitoring device, the monitoring device including a sensor and a tripping element, a position of the tripping element being variable after the firm connection and, when the switching appliance is ready to operate, the tripping element being located in a position which is detectable by the sensor, the monitoring device further including a signal unit, connected to the sensor, to signal operational readiness of the switching device upon the sensor detecting that the tripping element is in the position indicating that the switching device is ready to operate.

2. The switching device as claimed in claim 1, wherein the tripping element is configured to engage with a catch mechanism of the switching appliance, only when the switching device is ready to operate.

3. The switching device as claimed in claim 2, wherein the at least one connecting device is in the form of at least one screw.

4. The switching device as claimed in claim 2, wherein the sensor is electrically connected to the signal unit.

5. The switching device as claimed in claim 2, wherein the signal unit is in the form of a communication device.

6. The switching device as claimed in claim 1, wherein the at least one connecting device is in the form of at least one screw.

7. The switching device as claimed in claim 1, wherein the sensor is electrically connected to the signal unit.

8. The switching device as claimed in claim 1, wherein the signal unit is in the form of a communication device.

9. A method for signaling of operational readiness of a switching device including a switching appliance, a cap and at least one connecting device, by which the switching appliance is firmly connected to the cap, the method comprising:

changing a position of a tripping element after a connection of the switching appliance to the cap;

detecting, via a sensor, the tripping element in the changed position in which the switching appliance is ready to operate; and signaling the operational readiness in response to detecting that the tripping element is in the changed position.

* * * * *